US012163709B2

(12) United States Patent
Sakthivel

(10) Patent No.: US 12,163,709 B2
(45) Date of Patent: Dec. 10, 2024

(54) HOT GAS DEFROST USING A WORK RECOVERY DEVICE

(71) Applicant: Heatcraft Refrigeration Products LLC, Stone Mountain, GA (US)

(72) Inventor: Saravana Vaithilingam Sakthivel, Tamil Nadu (IN)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 47 days.

(21) Appl. No.: 17/857,429

(22) Filed: Jul. 5, 2022

(65) Prior Publication Data

US 2024/0011685 A1 Jan. 11, 2024

(51) Int. Cl.
*F25B 47/02* (2006.01)
*F25B 9/00* (2006.01)

(52) U.S. Cl.
CPC ..... *F25B 47/022* (2013.01); *F25B 9/008* (2013.01); *F25B 2400/23* (2013.01)

(58) Field of Classification Search
CPC ..... F25B 47/02; F25B 47/022; F25B 9/00; F25B 9/002; F25B 9/008; F25B 2400/23; F25B 2321/0251; F25B 2345/00; F25B 2345/001; F25B 2345/002; F25B 2345/004
See application file for complete search history.

(56) References Cited

U.S. PATENT DOCUMENTS 3,668,884 A * 6/1972 Nebgen ..... F25B 11/02 62/402
8,671,703 B2 * 3/2014 Mitra ..... F25B 1/10 62/509
9,353,980 B2 * 5/2016 Ignatiev ..... F25B 49/02
9,377,236 B2 * 6/2016 Hinde ..... F25D 21/06
11,029,068 B2 * 6/2021 Christensen ..... F25B 9/008
11,280,531 B2 * 3/2022 Ferretti ..... F25B 5/02
11,371,756 B2 * 6/2022 Zha ..... F25B 41/20
11,384,969 B2 * 7/2022 Zha ..... F25B 41/24
11,397,032 B2 * 7/2022 Newel ..... F25B 9/008
2010/0132399 A1 * 6/2010 Mitra ..... B60H 1/3228 62/512
2011/0023514 A1 * 2/2011 Mitra ..... F25B 1/10 62/513
2014/0326018 A1 * 11/2014 Ignatiev ..... F25B 49/02 62/527
2014/0352343 A1 * 12/2014 Hinde ..... F25B 7/00 62/277
2015/0143828 A1 * 5/2015 Atalla ..... F01K 7/22 60/671
2016/0102901 A1 * 4/2016 Christensen ..... F25B 9/008 62/196.4
2019/0368786 A1 * 12/2019 Newel ..... F25B 21/00
2020/0064037 A1 * 2/2020 Ferretti ..... F25B 41/22
(Continued)

FOREIGN PATENT DOCUMENTS

EP 3643987 A1 * 4/2020 ..... F25B 1/10

*Primary Examiner* — Miguel A Diaz
(74) *Attorney, Agent, or Firm* — Baker Botts L.L.P.

(57) ABSTRACT

A refrigeration system comprises a gas cooler, a flash tank, a work recovery device located downstream from the gas cooler, one or more evaporators unit located downstream from a second outlet of the work recovery device, and a controller communicatively coupled to the work recovery device.

20 Claims, 3 Drawing Sheets

(56) References Cited

U.S. PATENT DOCUMENTS

| | | | | |
|---|---|---|---|---|
| 2020/0132351 | A1* | 4/2020 | Zha | F25B 1/10 |
| 2022/0146168 | A1* | 5/2022 | Ferretti | F25B 5/02 |
| 2022/0205696 | A1* | 6/2022 | Ferretti | F25B 47/022 |
| 2022/0357081 | A1* | 11/2022 | Newel | F25B 9/008 |

* cited by examiner

HOT GAS DEFROST USING A WORK RECOVERY DEVICE

TECHNICAL FIELD

This disclosure relates generally to refrigeration systems and methods of their use. More particularly, in certain embodiments, this disclosure relates to hot gas defrost using a work recovery device.

BACKGROUND

Refrigeration systems are used to regulate environmental conditions within an enclosed space. Refrigeration systems are used for a variety of applications, such as in supermarkets and warehouses, to cool stored items. For example, refrigeration systems may provide cooling operations for refrigerators and freezers.

SUMMARY OF THE DISCLOSURE

During operation of refrigeration systems, ice may build up on evaporators. These evaporators need to be defrosted to remove ice buildup and prevent loss of performance. Previous evaporator defrost processes are limited in terms of their efficiency and effectiveness. For example, using previous technology, Low-Temperature compressor (LT) discharge was used to defrost the evaporators and the desired pressure difference between a flash tank and evaporators of a refrigeration system is not achieved to provide adequate defrosting. In another example, in some refrigeration systems, there may be no or partial LT evaporator load. The previous technology is not capable of providing hot gas defrosting in such refrigeration systems with no or partial LT evaporator load. In another example, the current LT compressors are not capable of raising the pressure of refrigerant to the desired level to provide a desired pressure difference across the evaporators to drive the refrigerant through refrigerant conduit for defrosting. In another example, in previous technology, there is not enough refrigerant mass flow rate as needed to defrost multiple evaporators at an instance. In another example, LT compressor discharge pressure switch imposed a restriction on the discharge pressure to have an efficient discharge.

This disclosure provides technical solutions to the problems of previous technology, including those described above. For example, a refrigeration system is described that provides the desired pressure difference across the evaporators to drive the refrigerant through refrigerant conduit. The refrigeration system described herein is configured to implement a work recovery device that is configured to provide the hot gas and the desired pressure difference across evaporators to drive the refrigerant through refrigerant conduit.

In the existing refrigeration technology, there is a pressure switch or pressure-relief valve located on the discharge side of the LT compressors that is used to control the pressure of refrigerant at the discharge of the LT compressors. The present disclosure contemplates an unconventional refrigeration system that obviates the need to increase the pressure rating of the pressure switch at the discharge side of the LT compressors. For example, by implementing the work recovery device that is configured to produce the desired pressure difference, there is no need to use the pressure switch with higher pressure setting at the discharge side of the LT compressors.

Furthermore, it is challenging to build a required pressure difference between refrigerant's pressure discharged from the LT compressors and refrigerant's pressure at the flash tank. By implementing the disclosed work recovery device that is configured to produce the hot gas and the desired pressure difference between the evaporators and the flash tank during defrost, the LT compressors can operate without being stressed to produce a high-pressure refrigerant. Thus, the efficiency of the LT compressors is improved, and the power consumption of the LT compressors is reduced.

The disclosed refrigeration system is further configured to provide a sufficient and required refrigerant mass flow rate in order to defrost multiple evaporators in an instance, e.g., by implementing the work recovery device and utilizing the mass flow rate from the Medium-Temperature (MT) compressor discharge. The present disclosure contemplates an unconventional refrigeration system configured to provide hot gas defrosting with no or partial LT evaporators.

Embodiments of this disclosure may provide improved defrost operations to evaporators of refrigeration systems, such as $CO_2$ transcritical refrigeration systems. The system is configured to provide an increased pressure differential to drive refrigerant flow in defrost mode operation. While one or a portion of the evaporators of the refrigeration system are operating, LT compressors used for refrigeration can still operate as usual without requiring increased pressure operation and without unnecessarily increasing power consumption. Thus, the present disclosure is integrated into practical applications of improving power consumption of the refrigeration systems, improving the efficiency of defrost operations of the refrigeration systems, and thus improving the underlying operations of the refrigeration systems.

As such, the refrigeration system of this disclosure provides improved defrost operations while also improving the energy efficiency of the refrigeration system. Certain embodiments may include none, some, or all of the above technical advantages. One or more other technical advantages may be readily apparent to one skilled in the art from the figures, descriptions, and claims included herein.

In an embodiment, a refrigeration system comprises a gas cooler, a flash tank, a work recovery device located downstream from the gas cooler, a first evaporator unit located downstream from a second outlet of the work recovery device, a second evaporator unit and a controller communicatively coupled to the work recovery device. The flash tank is configured to store refrigerant. The gas cooler is configured to receive the refrigerant and facilitate heat transfer from the received refrigerant, thereby cooling the refrigerant. The controller is configured to determine whether defrost of an evaporator of the first evaporator unit is needed. In response to determining that defrosting of the evaporator of the first evaporator unit is needed, the controller is configured to turn on the work recovery device. The controller is configured to cause the work recovery device, while turned on, to receive, at a first inlet, refrigerant cooled by the gas cooler. The controller is configured to cause the work recovery device, while turned on, to reduce a pressure of the refrigerant available on first inlet to the flash tank pressure. The controller is configured to cause the work recovery device, while turned on, to provide, from the first outlet, the refrigerant to the flash tank. The controller is configured to cause the work recovery device, while turned on, to receive, at a second inlet, refrigerant i.e., the flash gas vapor from the flash tank and/or the return gas from the second evaporator unit. The controller is configured to cause the work recovery device, while turned on, to increase a pressure of the refrigerant at second inlet to desired defrost pressure. The controller is configured to cause the work recovery device, while turned on, to provide, from a second outlet, the refrigerant to the first evaporator unit thereby defrosting the evaporator of the first evaporator unit.

BRIEF DESCRIPTION OF THE DRAWINGS

For a more complete understanding of the present disclosure, reference is now made to the following description, taken in conjunction with the accompanying drawings, in which.

DETAILED DESCRIPTION

Figure 1:
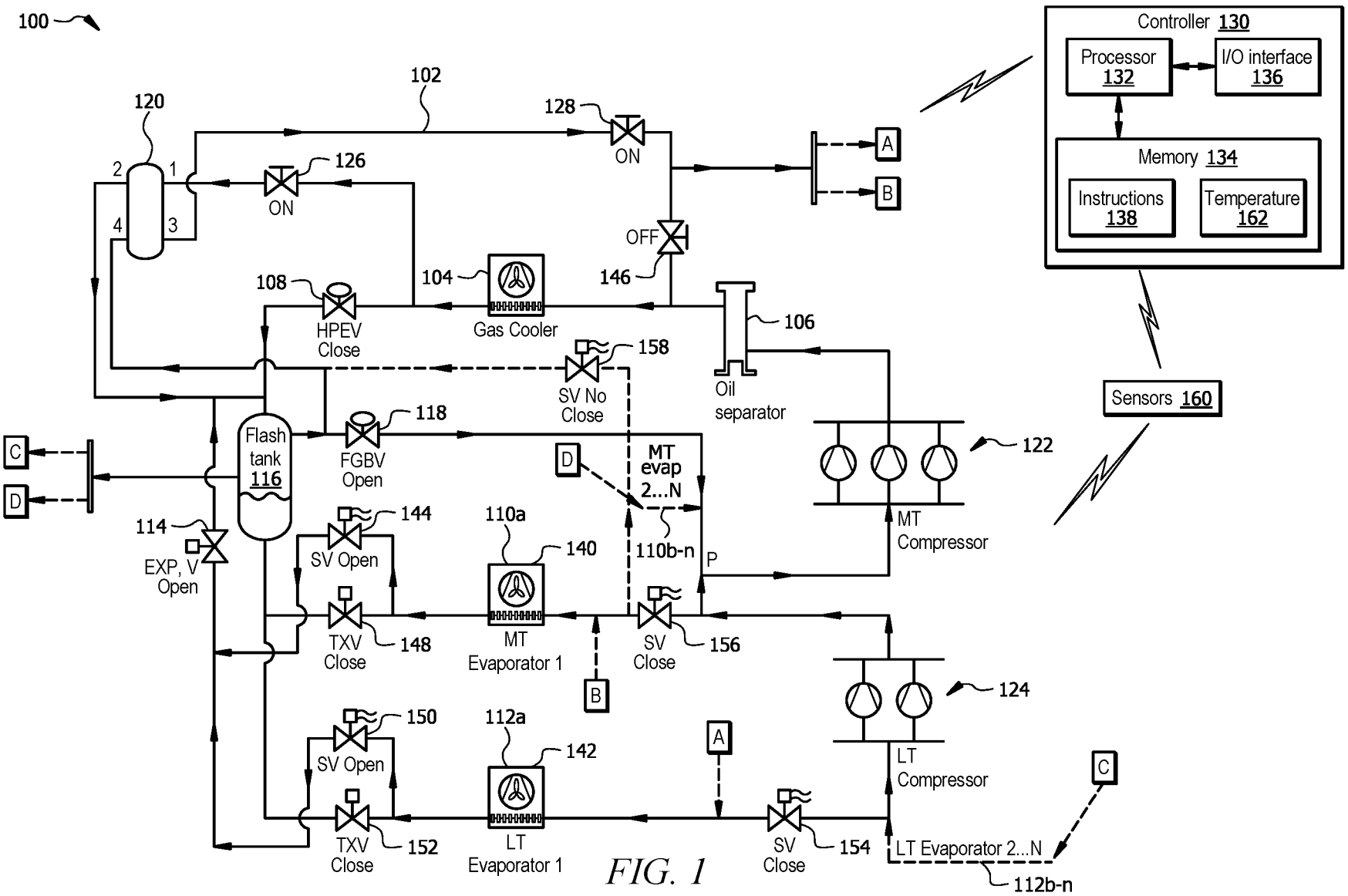
FIG. 1 is a diagram of an example refrigeration system with a work recovery device configured to operate a low temperature and medium temperature evaporator units in defrost mode when the ambient temperature is greater than a threshold.
Figure 2:
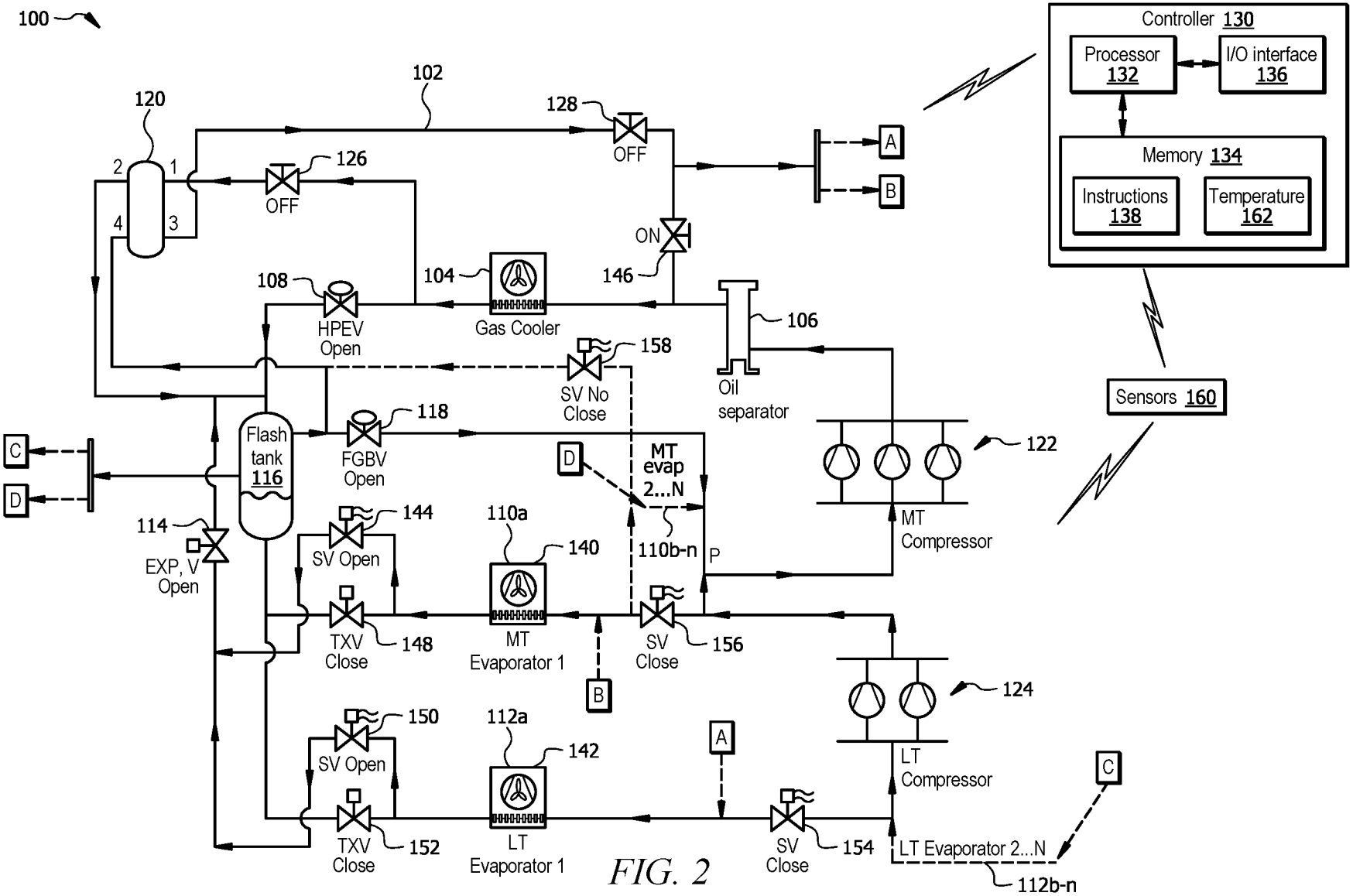
FIG. 2 is a diagram of the refrigeration system of FIG. 1 configured to operate a low temperature and medium temperature evaporator units in defrost mode when the ambient temperature is less than a threshold.
Figure 3:
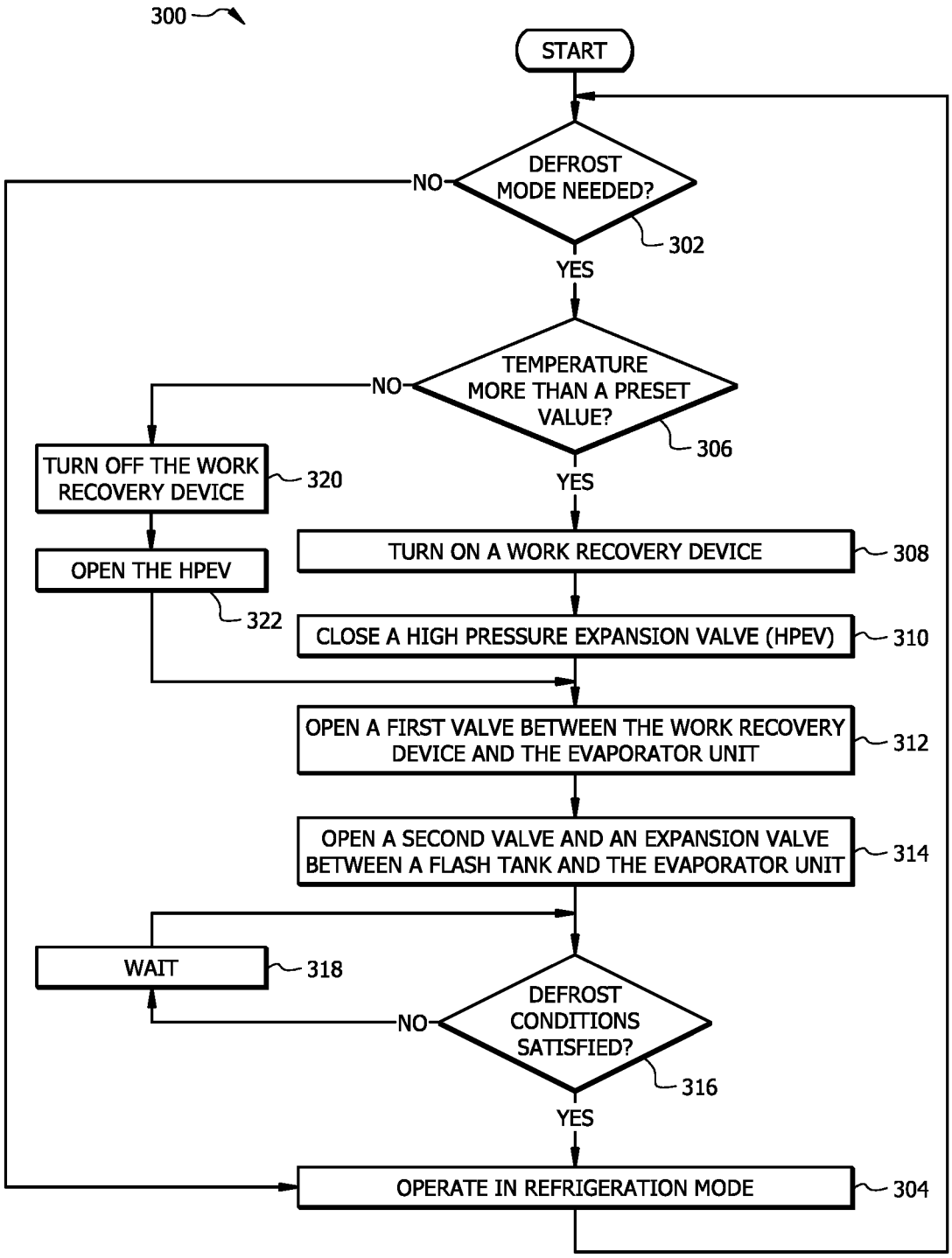
FIG. 3 is a flowchart of an example method of operating the refrigeration system of FIGS. 1 and 2 to provide improved evaporator defrost.

Embodiments of the present disclosure and its advantages are best understood by referring to FIGS. 1-3 of the drawings, like numerals being used for like and corresponding parts of the various drawings.

As described above, prior to this disclosure, defrost operations of refrigeration systems suffered from certain inefficiencies and drawbacks. The refrigeration system of this disclosure provides improvements in defrost performance and energy efficiency. In some cases, the refrigeration system may ensure that all appropriate defrost operations can be performed when needed, while previous technology may have been limited in the number of evaporators that could be defrosted at a given time or over a given period of time. In some cases, the refrigeration system may provide an improved defrost mode to evaporators by utilizing a work recovery device that is configured to produce the desired pressure difference between a flash tank and evaporators indicated and/or scheduled to be defrosted.

The refrigeration system of this disclosure may be a $CO_2$ transcritical refrigeration system. $CO_2$ transcritical refrigeration systems differ from conventional refrigeration systems in that transcritical systems circulate refrigerant that becomes a supercritical fluid (i.e., where distinct liquid and gas phases are not present) above the critical point. As an example, the critical point for carbon dioxide ($CO_2$) is 31° C. and 73.8 MPa, and above this point, $CO_2$ becomes a homogenous mixture of vapor and liquid that is called a supercritical fluid. This unique characteristic of transcritical refrigerants is associated with certain operational differences between transcritical and conventional refrigeration systems. For example, transcritical refrigerants are typically associated with discharge temperatures that are higher than their critical temperatures and discharge pressures that are higher than their critical pressures. When a transcritical refrigerant is at or above its critical temperature and/or pressure, the refrigerant may become a "supercritical fluid"—a homogenous mixture of gas and liquid. Supercritical fluid does not undergo phase change process (vapor to liquid) in a gas cooler as occurs in a condenser of a conventional refrigeration system circulating traditional refrigerant. Rather, supercritical fluid cools down to a lower temperature in the gas cooler. Stated differently, the gas cooler in a $CO_2$ transcritical refrigeration system receives and cools supercritical fluid and the transcritical refrigerant undergoes a partial state change from gas to liquid as it is discharged from an expansion valve.

Refrigeration System

FIGS. 1 and 2 illustrate an example refrigeration system 100 configured for improved defrost operation. The refrigeration system 100 shown in FIG. 1 is configured to operate the evaporator units 110*a* and 112*a* in defrost mode and evaporator units 110*b-n* and 112*b-n* in refrigeration mode, such that the evaporators 140 and 142 of the evaporator units 110*b-n* and 112*b-n*, respectively, provide cooling to a corresponding space, such as a freeze and deep freeze, respectively (not shown for clarity and conciseness). In FIG. 1, the refrigeration system 100 is configured to perform the defrost operation of the evaporator units 110*a* and 112*a* in a high ambient temperature environment (e.g., when the ambient temperature 162 and/or the temperature surrounding the refrigeration system 100 is more than a preset value, such as more than 30° C., more than 35° C. and the like) by utilizing the work recovery device 120. For example, when the controller 130 determines that defrost of the evaporator units 110*a* and 112*a* is needed and the temperature of the ambient is more than a preset value (e.g., more than ambient temperature, more than 30° C., more than 35° C., etc.), it may cause the work recovery device 120 to turn on and perform one or more operations described herein to defrost the evaporator units 110*a* and 112*a*.

In FIG. 2, refrigeration system 100 is configured to perform the defrost operation of the evaporator units 110*a* and 112*a* without the work recovery device 120. For example, when the controller 130 determines that defrost of the evaporator units 110*a* and 112*a* is needed and the ambient temperature 162 is less than the preset value (e.g., less than 30° C., less than 35° C., etc.), it may cause the work recovery device 120 to turn off and instead utilize hot gas directly from oil separator outlet for defrost operation of the evaporator units 110*a* and 112*a*. The temperature 162 may be the outdoor temperature or a temperature around the refrigeration system 100.

In certain embodiments, the refrigeration system 100 may include refrigerant conduit subsystem 102, gas cooler 104, oil separator 106, HPEV 108, one or more medium-temperature (MT) evaporator units 110*a-n*, one or more low-temperature (LT) evaporator units 112*a-n*, expansion valve 114, flash tank 116, Flash Gas Bypass Valve (FGBV) 118, the work recovery device 120, one or more MT compressors 122, one or more LT compressors 124, and the controller 130. In other embodiments, refrigeration system 100 may not have all of the components listed and/or may have other elements instead of, or in addition to, those listed above. In some embodiments, refrigeration system 100 is a transcritical refrigeration system that circulates a transcritical refrigerant such as $CO_2$.

Refrigerant conduit subsystem 102 facilitates the movement of refrigerant (e.g., $CO_2$) through a refrigeration cycle such that the refrigerant flows in the refrigeration mode as illustrated by the arrows in FIG. 1. The refrigerant conduit subsystem 102 includes conduit, tubing, and the like that facilitates the movement of refrigerant between components of the refrigeration system 100. For clarity and conciseness, only a single conduit of the refrigerant conduit subsystem 102 is labeled in FIGS. 1 and 2 as refrigerant conduit subsystem 102. The refrigerant conduit subsystem 102 includes any conduit, tubing, and the like that is illustrated in FIGS. 1 and 2 connecting components of the refrigeration system 100.

Gas cooler 104 is generally operable to receive refrigerant (e.g., from MT compressor(s) 122 or oil separator 106) and apply a cooling stage to the received refrigerant. In some embodiments, gas cooler 104 is a heat exchanger comprising cooler tubes configured to circulate the received refrigerant and coils through which ambient air is forced. The gas cooler 104 is configured to receive the refrigerant and facilitate heat transfer from the received refrigerant, thereby cooling the refrigerant. Inside gas cooler 104, the coils may absorb heat from the refrigerant, thereby cooling the refrigerant.

Oil separator 106 may be located downstream the MT compressors 122. The oil separator 106 is operable to separate compressor lubrication oil from the refrigerant. The refrigerant is provided to the gas cooler 104, while the oil may be collected and returned to the MT compressors 122, as appropriate.

HPEV 108 (also referred to herein as expansion valve 108) is disposed downstream of the gas cooler 104. The expansion valve 108 may be or include an electronic or a thermal expansion valve. The expansion valve 108 is configured to receive high-pressure (or vapor) refrigerant (e.g., from the gas cooler 104) and reduce the pressure of the received refrigerant to the desired level (e.g., to −38 bar). In some embodiments, this reduction in pressure causes some of the refrigerant to vaporize. As a result, mixed-state refrigerant (e.g., vapor refrigerant and liquid refrigerant) may be discharged from expansion valve 108. In some embodiments, this mixed-state refrigerant is discharged to flash tank 116. HPEV 108 may further be configured to regulate flow rate (and/or the pressure) of refrigerant at which it flows into the flash tank 116. In the present disclosure, the term turn on may be interchangeably referred to herein as open or at least partially open, and the term turn off may be interchangeably referred to herein as close or at least partially close.

In certain embodiments, when it is determined that defrost of the MT evaporator unit 110*a* and LT evaporator unit 112*a* is needed and the ambient temperature 162 is more than the preset value (e.g., more than 30° C., etc.) (defrost mode in FIG. 1), the controller 130 may close the HPEV 108, turn on or at least partially turn on (i.e., open or at least partially open) the valve 126, and turn on or at least partially turn on (i.e., open or at least partially open) the work recovery device 120 to allow the flow of the refrigerant cooled by the gas cooler 104 to the work recovery device 120. The high-pressure refrigerant from the gas cooler 104 expands in the work recovery device 120 thereby generating a mechanical power which is used to compress the flash gas from flash tank 116 or the return gas from the second evaporator unit 110*b-n* to the desired defrost pressure. This provides a technical advantage over the existing technology because in the existing technology there is not enough pressure difference between the evaporator and the flash tank to drive the refrigerant the refrigerant through refrigerant conduit and also to provide efficient defrost.

In the illustrated embodiment, the work recovery device 120 is implemented to produce the desired pressure difference between evaporator unit 110*a* and the flash tank 116 or between the evaporator unit 112*a* and the flash tank 116 to have an efficient defrost operation.

In certain embodiments, when it is determined that defrost of the MT evaporator unit 110*a* and LT evaporator unit 112*a* is needed and the ambient temperature 162 is less than a preset value (e.g., less than 30° C., etc.) (defrost mode in FIG. 2), the controller 130 may determine that the work recovery device 120 is not needed to produce the required pressure difference between refrigerant's pressure needed at the MT evaporator unit 110*a* and LT evaporator unit 112*a* and refrigerant's pressure needed at the flash tank 116. Thus, the controller 130 may turn off the work recovery device 120, open (or at least partially open) the expansion valve 108, and close (or at least partially close) the valve 126 to prevent the flow of the refrigerant cooled by the gas cooler 104 to the work recovery device 120. Valve 146 is switched open (or at least partially to supply hot gas for defrosting the MT evaporator unit 110*a* or the LT evaporator unit 112*a*.

Each of the MT evaporator units 110*a-n* is an instance of the MT evaporator unit 110. MT evaporator unit 110 is configured to operate at medium temperatures (e.g., for cooling or freezing applications near about −6° C. or the like). MT evaporator unit 110 includes an evaporator 140 and one or more valves (not explicitly shown) to facilitate the operation of the MT evaporator unit 110 in both refrigeration mode and defrost mode. As an example, the evaporator 140 may be part of a refrigerated case and/or cooler for storing food and/or beverages that must be kept at particular temperatures. The refrigeration system 100 may include any appropriate number of MT evaporator units 110*a-n* with the same or a similar configuration to that shown for the example MT evaporator unit 110*a*.

When the MT evaporator unit 110*a* is operated in refrigeration mode, the MT evaporator unit 110*a* receives cooled liquid refrigerant from the flash tank 116 and uses the cooled refrigerant to provide cooling.

When the MT evaporator unit 110*a* is operated in the defrost mode and the work recovery device 120 is utilized as illustrated in FIG. 1, the MT evaporator unit 110*a* receives refrigerant (from point B) traveled from the work recovery device 120 (via the open or at least partially open valve 128). The refrigerant melts the ice formed on components of the MT evaporator unit 110*a*. The valve 148 is closed. The valve 144 and expansion valve 114 are open (or at least partially open) and the refrigerant travels through the valve 144 and expansion valve 114 to the flash tank 116.

Valve 144 may be the same or similar to valves 150, 154, and 156. The valve 144 may be a solenoid valve. Thermostatic Expansion Valve (TXV) 148 may be the same or similar to the TXV 152. Valves 148 and 152 may be an electronic expansion valve also, for example. TXV 148 and 152 may be referred to herein as valves. The TXV 148 may be configured to regulate the rate (and/or the pressure) at which refrigerant flows in or from the MT evaporator unit 110*a* that is operating in refrigeration mode (not explicitly shown). Similarly, the TXV 152 may be configured to regulate the rate (and/or the pressure) at which refrigerant flows in or from the LT evaporator unit 112*a* that is operating in refrigeration mode (not explicitly shown).

When the MT evaporator unit 110*a* is operated in the defrost mode, the work recovery device 120 is not utilized and the HPEV 108 is utilized as illustrated in FIG. 2, the MT evaporator unit 110*a* receives refrigerant (from point B) traveled from the oil separator 106 (via the opened valve 146). The refrigerant melts the ice formed on components of the MT evaporator unit 110*a*. The valve 144 and expansion valve 114 are open (or at least partially open) and the refrigerant travels through the valve 144 and expansion valve 144 to the flash tank 116.

Each of the LT evaporator units 112*a-n* is generally similar to the MT evaporator units 110*a-n* but configured to operate at lower temperatures (e.g., for deep freezing applications near about −30° C. or the like). Each of the LT evaporator units 112*a-n* is an instance of the LT evaporator unit 112. When operated in refrigeration mode (not explicitly shown), the LT evaporator unit 112 receives cooled liquid refrigerant from the flash tank 116 and uses the cooled refrigerant to provide cooling. The LT evaporator unit 112 includes an evaporator 142 along with appropriate valves to facilitate the operation of the LT evaporator unit 112 in both a refrigeration mode and a defrost mode. As an example, the evaporator 142 may be part of a deep freezer for relatively long-term storage of perishable items that must be kept at particular temperatures. The refrigeration system 100 may include any appropriate number of LT evaporator units 112*a-n* with the same or a similar configuration to that shown for the LT evaporator unit 112.

When the LT evaporator unit 112*a* is operated in the defrost mode and the work recovery device 120 is utilized as illustrated in FIG. 1, the LT evaporator unit 112*a* receives refrigerant (from point A) traveled from the work recovery device 120 (via the open (or at least partially open) valve 128). The refrigerant melts the ice formed on components of the LT evaporator unit 112*a*. The valve 152 is closed. The valve 150 and expansion valve 114 are open (or at least partially open) and the refrigerant travels through the valve 150 and expansion valve 114 to the flash tank 116.

When the LT evaporator unit 112*a* is operated in the defrost mode, the work recovery device 120 is not utilized and the expansion valve 108 is utilized as illustrated in FIG. 2, the LT evaporator unit 112*a* receives refrigerant (from point A) traveled from the oil separator 106 (via the opened valve 146). The refrigerant melts the ice formed on components of the LT evaporator unit 112*a*. The valve 152 is closed. The valve 150 and expansion valve 114 are open (or at least partially open) and the refrigerant travels through the valve 150 and expansion valve 114 to the flash tank 116.

Expansion valve 114 is configured to expand the refrigerant (i.e., decreases pressure of the refrigerant) before it flows back into the flash tank 116. Expansion valve 114 may further be configured to regulate flow rate (and/or the pressure) of the refrigerant at which it flows into the flash tank 116. Expansion valve 114 may be the same as or similar to expansion valves 108, 148, and 152.

Flash tank 116 is configured to receive mixed-state refrigerant and separate the received refrigerant into flash gas and liquid refrigerant. Typically, the flash gas collects near the top of flash tank 116 and the liquid refrigerant is collected at the bottom of flash tank 116. In some embodiments, the liquid refrigerant flows from flash tank 116 and provides cooling to the MT evaporator unit 110*a* and LT evaporator unit 112*a* when they are in defrost mode.

Work recovery device 120 is generally a device that is configured to increase and decrease pressure of refrigerant. In certain embodiments, the work recovery device 120 may include a turbine-compressor assembly device. In certain embodiments, the work recovery device 120 may include a device that is configured to decrease the pressure of refrigerant, such as a turbine, a rotating device, an expander, a scroll expander, a reciprocating piston expander, and the like. In certain embodiments, the work recovery device 120 may further include a device that is configured to increase the pressure of refrigerant, such as a compressor and the like. For example, the work recovery device 120 may receive a high-pressure refrigerant at inlet 1. The turbine expands and reduces the pressure of the refrigerant. The low-pressured refrigerant is outputted from the outlet 2 to the flash tank 116.

The work recovery device 120 is configured to receive low-pressured refrigerant from inlet 4. As a result of expansion of the high-pressure refrigerant described above, a mechanical force is generated within the work recovery device 120. The mechanical force is used to trigger a compressor inside the work recovery device 120. For example, the mechanical force is used to rotate a shaft coupled to the compressor inside the work recovery device 120 to turn on the compressor and use the compressor to increase the pressure of low-pressured refrigerant inside the work recovery device 120. The generated high-pressured refrigerant is outputted from outlet 3 to the MT evaporator unit 110*a* and LT evaporator unit 112*a* (via the open or at least partially open valve 128) that are operated in defrost mode.

Refrigerant from the MT evaporator units 110*a-n* that are operating in refrigeration mode is provided to the one or more MT compressors 122. MT compressor(s) 122 is generally a compressor device that is configured to operate in medium temperature (e.g., for cooling or freezing applications near about −6° C. or the like). The MT compressor 122 is configured to compress refrigerant discharged from the MT evaporator units 110*b-n* that are operating in refrigeration mode (not explicitly shown) and/or from the flash tank 116 via the opened Flash Gas Bypass Valve (FGBV) 118. The MT compressor 122 is further configured to provide supplemental compression to refrigerant discharged from any of the LT evaporator units 112*b-n* that are operating in refrigeration mode (not explicitly shown). Refrigeration system 100 may include any suitable number of MT compressors 122. MT compressor(s) 122 may vary by design and/or by capacity. For example, some compressor designs may be more energy efficient than other compressor designs, and some MT compressors 122 may have modular capacity (e.g., a capability to vary capacity). The controller 130 may be in communication with the MT compressors 122 and controls their operation.

Refrigerant from the LT evaporator units 112*a-n* that are operating in refrigeration mode is provided to the one or more LT compressors 124. LT compressor(s) 124 is generally similar to the MT compressor 122 except that it is configured to operate at low temperature (e.g., for deep freezing applications near about −30° C. or the like). The LT compressor 124 may be configured to compress refrigerant discharged from the LT evaporator units 112*b-n* that are operating in the refrigeration mode (not explicitly shown). The compressed refrigerant from the LT compressor 124 is provided to the MT compressor 122 for supplemental compression.

Furthermore, it is challenging to build a required pressure difference between refrigerant's pressure discharged from the LT compressors 124 and refrigerant's pressure at the flash tank 116. By implementing the work recovery device 120 that is configured to produce the desired pressure difference between refrigerant's pressure available for defrost refrigerant's pressure at the flash tank 116, the LT compressors 124 can operate without being stressed to produce a high-pressure refrigerant. Thus, the efficiency of the LT compressors 124 is improved and the power consumption of the LT compressors 124 is reduced.

Refrigeration system 100 may include any suitable number of LT compressors 124. LT compressor(s) 124 may vary by design and/or by capacity. For example, some compressor designs may be more energy-efficient than other compressor designs, and some LT compressors 124 may have modular capacity (e.g., a capability to vary capacity). The controller 130 may be in communication with the LT compressors 124 and controls their operation.

Controller 130 may be any computing device that is generally configured to implement defrost and refrigeration modes for one or more MT and LT evaporator units 110*a-n* and 112*a-n*. The controller 130 may be in signal communication with other components of the refrigeration system 100. For example, the controller 130 is in communication with the work recovery device 120, MT evaporator units 110*a-n*, LT evaporator units 112*a-n*, expansion valve 114, flash tank 116, FGBV 118, MT compressors 122, LT compressors 124, gas cooler 104, valves 126, 128, 146, 144, 148, 150, 152, 154, 156, 158, oil separator 106, HPEV 108, sensors 160, among other components. The controller 130 is configured to adjust the operation of the components of the refrigeration system 100 to operate the MT evaporator unit 110*a* and LT evaporator unit 112*a* in refrigeration mode (not explicitly shown) and in a first defrost mode by utilizing the work recovery device 120 (as illustrated in FIG. 1) and in a second defrost mode by not utilizing the work recovery device 120 and instead utilizing the HPEV 108 (as illustrated in FIG. 2) as appropriate.

In certain embodiments, the controller 130 includes a processor 132, a Input/Output (I/O) interface 136, and/or a memory 134. The components of the controller 130 are in signal communication with each other.

The processor 132 includes one or more processors operably coupled to the memory 134. The processor 132 is any electronic circuitry including, but not limited to, state machines, one or more central processing unit (CPU) chips, logic units, cores (e.g. a multi-core processor), field-programmable gate array (FPGAs), application specific integrated circuits (ASICs), or digital signal processors (DSPs) that communicatively couples to memory 134 and controls the operation of refrigeration system 100.

The processor 132 may be a programmable logic device, a microcontroller, a microprocessor, or any suitable combination of the preceding. The processor 132 is communicatively coupled to and in signal communication with the memory 134. The one or more processors are configured to process data and may be implemented in hardware or software. For example, the processor 132 may be 8-bit, 16-bit, 32-bit, 64-bit or of any other suitable architecture. The processor 132 may include an arithmetic logic unit (ALU) for performing arithmetic and logic operations, processor registers that supply operands to the ALU and store the results of ALU operations, and a control unit that fetches instructions from memory 134 and executes them by directing the coordinated operations of the ALU, registers, and other components. The processor 132 may include other hardware and software that operates to process information, control the refrigeration system 100, and perform any of the functions described herein (e.g., with respect to FIGS. 1-3). The processor 132 is not limited to a single processing device and may encompass multiple processing devices. Similarly, the controller 130 is not limited to a single controller but may encompass multiple controllers.

The memory 134 includes one or more disks, tape drives, or solid-state drives, and may be used as an over-flow data storage device, to store programs when such programs are selected for execution, and to store instructions and data that are read during program execution. The memory 134 may be volatile or non-volatile and may include ROM, RAM, ternary content-addressable memory (TCAM), dynamic random-access memory (DRAM), and static random-access memory (SRAM). The memory 134 is operable (e.g., or configured) to store information used by the controller 130 and/or any other logic and/or instructions for performing the function described in this disclosure. For example, the memory 134 may store instructions 138 for performing the functions of the controller 130 described in this disclosure. The instructions 138 may include, for example, a schedule for performing defrost mode operations, threshold temperature and/or pressure levels for determining when defrost is complete (e.g., based on information from sensors 160 or other sensors of the refrigeration system 100), and the like.

The I/O interface 136 is configured to communicate data and signals with other devices. For example, the I/O interface 136 may be configured to communicate electrical signals with components of the refrigeration system 100 including the work recovery device 120, MT evaporator units 110*a-n*, LT evaporator units 112*a-n*, expansion valve 114, flash tank 116, FGBV 118, MT compressors 122, LT compressors 124, gas cooler 104, valves 126, 128, 146, 144, 148, 150, 152, 154, 156, 158, oil separator 106, HPEV 108, sensors 160, among other components. The I/O interface 136 may be configured to communicate with other devices and systems. The I/O interface 136 may provide and/or receive, for example, compressor speed signals, compressor on/off signals, temperature signals, pressure signals, temperature setpoints, environmental conditions, and an operating mode status for the refrigeration system 100 and send electrical signals to the components of the refrigeration system 100. The I/O interface 136 may include ports or terminals for establishing signal communications between the controller 130 and other devices. The I/O interface 136 may be configured to enable wired and/or wireless communications.

Although this disclosure describes and depicts refrigeration system 100 including certain components, this disclosure recognizes that refrigeration system 100 may include any suitable components. As an example, refrigeration system 100 may include one or more additional sensors 160 configured to detect temperature and/or pressure information. In some embodiments, each of the conduit subsystem 102, compressors 122, 124, gas cooler 104, flash tank 116, and evaporator units 110*a-n*, 112*a-n*, oil separator 106, and other components of the refrigeration system 100 may include one or more sensors to, for example, detect pressure and/or temperature of refrigerant.

Sensors 160 may include any type of sensor, including a temperature sensor, a pressure sensor, among others. The sensors 160 may detect the temperature 162. One or more sensors 160 may be deployed at any appropriate locations to detect the temperature 162 and temperatures of components of the refrigeration system 100. For example, one or more sensors 160 may be deployed adjacent to the MT and/or LT evaporators 140, 142. In another example, one or more sensors 160 may be deployed at any appropriate location on the refrigerant conduit subsystem 102.

The sensors 160 are in signal communication with the controller 130. For example, if the controller 130 determines that the ambient temperature 162 is more than a preset value (e.g., more than 30° C., etc.) and that defrost mode of the MT and LT evaporator units 110*a* and 112*a* is needed, it may transmit the first set of instructions 138 to one or more components of the refrigeration system 100 to defrost the MT and LT evaporator units 110*a* and 112*a* to achieve the configuration and status of the valves 114, 126, 128, 144, 146, 148, 150, 152, 154, 156, turn on the work recovery device 120, close the HPEV 108, as illustrated in FIG. 1.

In another example, if the controller 130 determines that the ambient temperature 162 is less than the preset value (e.g., less than 30° C., etc.) and that defrost mode of the MT and LT evaporator units 110*a* and 112*a* is needed, it may transmit the first set of instructions 138 to one or more components of the refrigeration system 100 to defrost the MT and LT evaporator units 110*a* and 112*a* to achieve the configuration and status of the valves 114, 126, 128, 144, 146, 148, 150, 152, 154, 156, turn off the work recovery device 120, open the HPEV 108 as illustrated in FIG. 2. The controller 130 may provide instructions for adjusting the valves 144, 150, 154, and 156 to opened, partially opened, closed, or partially closed positions to achieve the configuration of FIG. 1 for the defrost mode operation of the MT evaporator units 110*a* and LT evaporator unit 112*a* in high ambient temperature environment by utilizing the work recovery device 120. The valve 144 may be configured to regulate flow rate (and/or the pressure) of refrigerant received from MT evaporator unit 110*a*. The valve 150 may be configured to regulate flow rate (and/or the pressure) of refrigerant received from LT evaporator unit 112*a*.

For example, instructions 138 implemented by the processor 132 of the controller 130 may determine that operation of the first evaporator unit 110*a* in a defrost mode is indicated and the temperature 162 is determined to be more than a preset value (e.g., by the sensor 160). For example, instructions 138 stored by the controller 130 may indicate that defrost mode operation is needed on a certain schedule or at a certain time. As another example, a temperature of the evaporator 140 may indicate that defrost mode operation is needed (e.g., because the temperature indicates that expected cooling performance or efficiency is not being obtained). When defrost mode is indicated in the high ambient temperature environment (i.e., when the ambient temperature 162 is greater than a threshold, e.g., greater than 30° C., etc.), the controller 130 turns on the work recovery device 120, opens (or at least partially opens) the valves 126, 128, expansion valve 114, and valves 144, 150, and closes (or at least partially closes) the valves 146, 148, 152, 154, 156, HPEV 108 to obtain the defrost mode configuration illustrated in FIG. 1.

Once defrost mode in the high ambient temperature environment is complete, the controller 130 may end defrost mode operation illustrated in FIG. 1. In some embodiments, the controller 130 may cause defrost mode to end after a predefined period of time included in the instructions 138. In some embodiments, the controller 130 may cause defrost mode operation to end after predefined conditions indicated in the instructions 138 are measured by the temperature and/or pressure sensor 160.

Referring to FIG. 2, the controller 130 may provide instructions for adjusting the valves 144, 150, 154, and 156 to opened, partially opened, closed, or partially closed positions to achieve the configuration of FIG. 2 for the defrost mode operation of the MT evaporator units 110*a* and LT evaporator unit 112*a* in a low ambient temperature environment (i.e., when the ambient temperature 162 is less than a threshold, e.g., less than 30° C., etc.) by not utilizing the work recovery device 120 and instead utilizing the HPEV 108.

For example, when defrost mode of MT evaporator units 110*a* and LT evaporator unit 112*a* is indicated in a low ambient temperature environment, the controller 130 turns off the work recovery device 120, closes (or at least partially closes) the valves 126, 128, opens (or at least partially opens) expansion valve 114, and valves 144, 146, 150, HPEV 108, and closes (or at least partially closes) valves 148 152, 154, 156 to obtain the defrost mode configuration illustrated in FIG. 2.

Once defrost mode in a low ambient temperature environment is complete, the controller 130 may end defrost mode operation illustrated in FIG. 2. In some embodiments, the controller 130 may cause defrost mode to end after a predefined period of time included in the instructions 138. In some embodiments, the controller 130 may cause defrost mode operation to end after predefined conditions indicated in the instructions 138 are measured by the temperature and/or pressure sensor 160.

Example Defrost Operation in a High Ambient Temperature Environment

In an example operation of the refrigeration system 100 in a high ambient temperature environment (e.g., when the ambient temperature 162 is more than a threshold, e.g., more than 30° C., etc.), the refrigeration system 100 may be configured as illustrated in FIG. 1 to operate the MT evaporator unit 110*a* and LT evaporator unit 112*a* in defrost mode. In other words, the refrigeration system 100 is configured to implement defrost mode for MT evaporator unit 110*a* and LT evaporator unit 112*a* in a high ambient temperature environment as illustrated in FIG. 1. For example, this process may be triggered when the temperature 162 of the environment surrounding the refrigeration system 100 (detected by the sensors 160) is more than a preset value (e.g., more than 30° C., etc.). In this operation, the controller 130 causes the work recovery device 120 to turn on and HPEV 108 to close. For example, the controller 130 sends instructions 138 that instructs the work recovery device 120 to turn on and the HPEV 108 to close. In another example, the instructions 138 to the work recovery device 120 may indicate to perform one or more operations of the work recovery device 120 described herein.

The refrigerant traveled from MT evaporator units 110*b-n* that are operating in refrigeration mode is provided to the MT compressors 122. The MT compressor 122 increases the pressure of the refrigerant (e.g., to ~90 bar or the like). The high-pressured refrigerant travels to the oil separator 106. The oil separator 106 separates the lubrication oil from the refrigerant and provides the high-pressured refrigerant to the gas cooler 104. The gas cooler 104 cools the received refrigerant. The refrigerant from the gas cooler 104 comprises vapor refrigerant. The cooled refrigerant travels through the valve 126 and reaches the work recovery device 120. In this operation, the controller 130 turns off or closes the valve 146. Thus, refrigerant traveling from the oil separator 106 cannot pass the valve 146.

The work recovery device 120 receives the high-pressured cooled refrigerant passed the valve 126 at the inlet 1. The work recovery device 120 reduces the pressure of the received refrigerant and outputs a low-pressured refrigerant (e.g., refrigerant at ~38 bar pressure level) at outlet 2. The low-pressured refrigerant travels to the flash tank 116.

To supply refrigerant with the required pressure and temperature to defrost the MT evaporator unit 110*a* and LT evaporator unit 112*a*, the refrigeration system 100 (via the work recovery device 120) produces a high-pressure refrigerant (e.g., refrigerant at ~58 bar pressure level) as described below.

The refrigerant at the flash tank 116 and/or refrigerant from one or more MT evaporator units 110*b-n* and/or one or more LT evaporator units 112*b-n* that are operating in refrigeration mode may flow to the inlet 4 of the work recovery device 120. For example, in some cases where multiple MT and/or LT evaporator units 110, 112 are needed to be operated in defrost mode at the same time (e.g., in high ambient temperature environment), the vapor refrigerant from the flash tank 116 may not have sufficient pressure level and/or flow rate to defrost the MT and/or LT evaporator units 110, 112 efficiently. In such cases, return gas (i.e., return vapor refrigerant from other MT and/or LT evaporator units 110, 112 that are operating in refrigeration mode) may be used (in addition or instead of the refrigerant from the flash tank 116) to supply high-pressured refrigerant to defrost the MT and/or LT evaporator units 110, 112 are needed to be operated in defrost mode. Thus, refrigerant at the flash tank 116 and/or refrigerant from one or more MT evaporator units 110*b-n* and/or one or more LT evaporator units 112*b-n* that are operating in refrigeration mode (shown by dashed line) may flow to the inlet 4 of the work recovery device 120.

The work recovery device 120 increases the pressure of the received refrigerant and outputs the high-pressured refrigerant at outlet 3. For example, the high-pressured refrigerant may have a ~58 bar pressure level. In certain embodiment, the pressure of the refrigerant may be set by the work recovery device 120 operating according to the instructions 138 received from the controller 130 as appropriate.

The high-pressured refrigerant travels through the open (or at least partially open) valve 128 to points A and B as illustrated in FIG. 1. Point B is connected (directly or indirectly) to the inlet of the MT evaporator unit 110*a*. The refrigerant travels through the MT evaporator unit 110*a* and melts the ice formed on components of the MT evaporator unit 110*a* (i.e., defrost the evaporator 140). The refrigerant flows through the open (or at least partially open) valve 144 and expansion valve 114 to the flash tank 116. The TXV 148 is closed in this configuration as shown in FIG. 1. Point A is connected (directly or indirectly) to the inlet of the LT evaporator unit 112*a*. The refrigerant travels through the LT evaporator unit 112*a* and melts the ice formed on components of the LT evaporator unit 112*a* (i.e., defrost the evaporator 142). The refrigerant flows through the open (or at least partially open) valve 144 and expansion valve 144 to the flash tank 116. The TXV 152 is closed in this configuration as shown in FIG. 1.

In the illustrated embodiment, the supply for the refrigerant to defrost the MT and LT evaporator units 110*a* and 112*a* may flow from the LT evaporator units 112*b-n* and MT evaporator units 110*b-n* that are operating in refrigeration mode. To this end, the refrigerant flows from the LT evaporator units 112*b-n* to the LT compressors 124. The LT compressors 124 compress the received refrigerant. The compressed refrigerant travels to the MT compressors 122 because the valve 156 is closed as shown in FIG. 1.

In certain embodiments, vapor refrigerant from the flash tank 116 may flow through open (or at least partially open) FGBV 118 and arrive at point P. In certain embodiments, refrigerant traveled from MT evaporator units 110*b-n* that are in refrigeration mode may travel to point P and mix withe the other refrigerant traveled from LT compressors 124 and flash tank 116. These mixed refrigerants may travel to the MT compressors 122. The MT compressors 122 compress the received refrigerant and increase the pressure of the received refrigerant. The MT compressors 122 may supply the refrigerant to the oil separator 106 similar to that described above.

In certain embodiments, while the MT evaporator unit 110*a* and LT evaporator unit 112*a* are in defrost mode, other MT evaporator units 110*b-n* and LT evaporator units 112*b-n* are in refrigeration mode. During refrigeration mode of the MT evaporator units 110*b-n* and LT evaporator units 112*b-n*, the refrigerant cooled by the gas cooler 104 travels through the open (or at least partially open) HPEV 108 to the flash tank 116. Liquid-phase refrigerant in the flash tank 116 is provided to points C and D. Point C is (directly or indirectly) connected to the LT evaporator units 112*b-n*. The liquid-phase refrigerant is provided to the LT evaporator units 112*b-n* to provide cooling. Point D is (directly or indirectly) connected to the MT evaporator units 110*b-n*. The liquid-phase refrigerant is provided to the MT evaporator units 110*b-n* to provide cooling.

Throughout this operation, the controller 130 provides instructions 138 to the components of the refrigeration system 100 to operate as described above to defrost the MT evaporator unit 110*a* and LT evaporator unit 112*a* in a high ambient temperature environment.

Example Defrost Operation in a Low Ambient Temperature Environment

FIG. 2 illustrates an example configuration of the refrigeration system 100 configured to implement defrost mode for MT evaporator unit 110*a* and LT evaporator unit 112*a* in a low ambient temperature environment (e.g., less than 30° C. or the like). In an example operation of the refrigeration system 100 in a low ambient temperature environment (e.g., when the ambient temperature 162 is less than a threshold, e.g., less than 30° C., etc.), the refrigeration system 100 may be configured as illustrated in FIG. 2 to operate the MT evaporator unit 110*a* and LT evaporator unit 112*a* in defrost mode. For example, this process may be triggered when the temperature 162 (detected by the sensors 160) is less than a preset value (e.g., less than 30° C., etc.). In this operation, the controller 130 causes the work recovery device 120 to turn off and HPEV 108 to open. For example, the controller 130 sends instructions 138 that instruct the work recovery device 120 to turn off and the HPEV 108 to turn on. In this operation, the work recovery device 120 is not utilized.

To supply refrigerant for defrosting the MT evaporator unit 110*a* and LT evaporator unit 112*a*, the refrigerant compressed by the MT compressors 122 travels to the oil separator 106 and through the valve 146 to points A and B. The refrigerant arrived at point B travels through the MT evaporator unit 110*a* and defrosts the evaporator 140 of the MT evaporator unit 110*a* (i.e., melts the ice formed on the evaporator 140). The refrigerant then travels through the open (or at least partially open) valve 144 and expansion valve 114 and reaches the flash tank 116.

The refrigerant arrived at point A travels through the LT evaporator unit 112*a* and defrosts the evaporator 142 of the LT evaporator unit 112*a* (i.e., melts the ice formed on the evaporator 142). The refrigerant then travels through the open (or at least partially open) valve 150 and expansion valve 114 and reaches the flash tank 116.

In certain embodiments, while the MT evaporator unit 110*a* and LT evaporator unit 112*a* are in defrost mode, other MT evaporator units 110*b-n* and LT evaporator units 112*b-n* are in refrigeration mode. When the MT evaporator units 110*b-n* and LT evaporator units 112*b-n* are in refrigeration mode, the refrigerant cooled by the gas cooler 104 travels through the open (or at least partially open) HPEV 108 to the flash tank 116. Liquid-phase refrigerant in the flash tank 116 is provided to points C and D. Point C is (directly or indirectly) connected to the LT evaporator units 112*b-n*. The liquid-phase refrigerant is provided to the LT evaporator units 112*b-n* to provide cooling. Point D is (directly or indirectly) connected to the MT evaporator units 110*b-n*. The liquid-phase refrigerant is provided to the MT evaporator units 110*b-n* to provide cooling.

Example Method of Operation

FIG. 3 illustrates a method 300 of operating the refrigeration system 100 described above with respect to FIGS. 1-2. The method 300 may be implemented using the processor 132, memory 134, and I/O interface 136 of the controller 130 of FIGS. 1 and 2. For example, the controller 130 may execute the instructions 138 to perform one or more operations of method 300.

Method 300 may begin at operation 302 where the controller 130 determines whether defrost mode is needed for any of the evaporator units 110*a-n*, 112*a-n*. For example, the controller 130 may determine whether the instructions 138 indicate that a defrost cycle is scheduled for one of the evaporator units 110*a-n*, 112*a-n*. As another example, the controller 130 may determine whether a temperature measured at an evaporator 140, 142 indicates decreased performance (e.g., if a target temperature is not being reached). This behavior may indicate that a defrost mode operation is indicated and/or needed. If defrost mode is not indicated and/or needed, the controller 130 proceeds to operation 304 and operates the evaporator units 110*a-n*, 112*a-n* in the refrigeration mode. If defrost mode operation is indicated and/or needed, the controller 130 may proceed to operation 306. For example, assume that defrost mode for MT evaporator unit 110*a* and LT evaporator unit 112*a* is needed and/or indicated.

At operation 306, the controller determines whether the temperature 162 (e.g., the outdoor temperature) is more than a preset value (e.g., more than 30° C. or the like). For example, the controller 130 receives the outdoor temperature 162 from one or more sensors 160. If the controller 130 determines that the temperature 162 is more than the preset value (e.g., it is a high ambient temperature environment), the controller 130 proceeds to operation 308. Otherwise, the controller 130 proceeds to operation 320.

At operation 308, the controller 130 causes the work recovery device 120 to turn on. For example, the controller 130 transmits instructions 138 that trigger the work recovery device 120 to turn on. This operation causes the refrigerant to flow from the gas cooler 104 to the inlet 1 of the work recovery device 120 via the open (or at least partially open) valve 126. The controller 130 causes the valve 126 to open to allow the refrigerant flow from the gas cooler 104 to the work recovery device 120.

At operation 310, the controller 130 closes the HPEV 108. For example, the controller 130 transmits instructions 138 that trigger the HPEV 108 to get closed (or at least partially get closed).

At operation 312, the controller 130 causes the first valve 128 between the work recovery device 120 and the evaporator units 110*a*, 112*a* to open (or at least partially open). The controller 130 also causes the valve 126 to open (or at least partially open). This allows the refrigerant cooled by the gas cooler 104 to flow (through the valve 126) to the inlet 1 of the work recovery device 120. The work recovery device 120 decreases the pressure of the received refrigerant and outputs the low-pressured refrigerant from outlet 2 of the work recovery device 120. The refrigerant travels from the outlet 2 to the flash tank 116. The controller 130 also causes the FGBV 118 to open (or at least partially open). This allows refrigerant from the flash tank 116 (and/or from evaporator units 110*b-n*, 112*b-n* that are in refrigeration mode) to travel to the inlet 4 of the work recovery device 120. The work recovery device 120 increases the pressure of the received refrigerant and outputs the high-pressured refrigerant from the outlet 3 of the work recovery device 120. The controller 130 causes the valve 128 to open (or at least partially open). This allows the refrigerant to flow from the outlet 3 of the work recovery device 120 to points A and B. From points A and B, the refrigerant travels through the evaporator units 112*a*, 110*a*, respectively, thereby defrosting the evaporator units 112*a*, 110*a*, similar to that described in FIG. 1.

At operation 314, the controller 130 causes the second valve 144, 150 and expansion valve 114 between the flash tank 116 and the evaporator units 110*a*, 112*a* to open, respectively. This allows the refrigerant to flow from the evaporator units 110*a*, 112*a* to the flash tank 116 through the valves 144, 150, respectively, and the expansion valve 114.

At operation 316, the controller 130 determines whether defrost conditions are satisfied for ending defrost mode operation. The defrost conditions may be indicated by the instructions 138. For example, the defrost conditions may indicate that defrost mode operation must be performed for a predefined period of time. As another example, the defrost conditions may indicate that an output temperature at or near the positions of sensor 160 must increase to at least a predefined temperature (e.g., of about 11° C.) before defrost mode operation is complete. If the defrost conditions are not met, the controller 130 proceeds to operation 318 to wait a period of time before returning to operation 316. If the defrost conditions of operation 316 are satisfied, the controller 130 proceeds to operation 304 and returns to operating in the refrigeration mode.

At operation 320, the controller 130 turns off the work recovery device 120. For example, the controller 130 transmits instructions 138 indicating to turn off the work recovery device 120 to the work recovery device 120.

At 322, the controller 130 causes the HPEV 108 to open (or at least partially open). For example, the controller 130 transmits instructions 138 indicating to open (or at least partially open) the HPEV 108 to the HPEV 108. The controller 130 may also cause the valve 128 to close, valve 146 to open (or at least partially open) to allow flow of the refrigerant from the oil separator 106 to points A and B to defrost the evaporators 140,142 of evaporator units 110*a*, 112*a*, respectively, similar to that described in FIG. 2.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

What is claimed is:

1. A refrigeration system, comprising a gas cooler, a flash tank, a work recovery device located downstream from the gas cooler, a first evaporator unit located downstream from a second outlet of the work recovery device, and a controller communicatively coupled to the work recovery device, wherein:

the flash tank is configured to store refrigerant;

the gas cooler is configured to receive the refrigerant and facilitate heat transfer from the received refrigerant, thereby cooling the refrigerant;

the controller is configured to:

determine whether defrost of an evaporator of the first evaporator unit is needed;

in response to determining that defrosting of the evaporator of the first evaporator unit is needed:

turn on the work recovery device;

cause the work recovery device, while turned on, to:

receive, at a first inlet, a first flow of refrigerant cooled by the gas cooler;

reduce a pressure of the first flow of refrigerant;

provide, from a first outlet, the first flow of refrigerant to the flash tank;

receive, at a second inlet, a second flow of refrigerant from at least one of the flash tank or a second evaporator unit that is operated in a refrigeration mode;

increase a pressure of the second flow of refrigerant; and provide, from the second outlet, the second flow of refrigerant to the first evaporator unit thereby defrosting the evaporator of the first evaporator unit;

wherein the work recovery device comprises a turbine.

2. The refrigeration system of claim 1, wherein the second evaporator unit is located downstream from the second outlet of the work recovery device, wherein:

the controller is further configured to:

determine whether defrost of an evaporator of the second evaporator unit is needed;

in response to determining that defrosting of the evaporator of the second evaporator unit is needed:

turn on the work recovery device; and cause the work recovery device, while turned on, to provide, from the second outlet, the second flow of refrigerant to the second evaporator unit thereby defrosting the evaporator of the second evaporator unit.

3. The refrigeration system of claim 1, further comprising a refrigerant conduit configured to allow:

the first flow of refrigerant from the gas cooler to the work recovery device, wherein the first flow of refrigerant from the gas cooler comprises vapor refrigerant; and the second flow of refrigerant from the flash tank to the work recovery device.

4. The refrigeration system of claim 1, wherein the refrigerant provided to the gas cooler is supplied from at least one of the first and second evaporator units that are operating in the refrigeration mode.

5. The refrigeration system of claim 1, wherein the controller is further configured to, in response to determining that the work recovery device is not needed to defrost the evaporator of the first evaporator unit, turn off the work recovery device.

6. The refrigeration system of claim 1, wherein the controller is further configured to, in response to determining that defrosting of the evaporator of the first evaporator unit is needed, at least partially open a first valve to allow of the first flow of refrigerant from the gas cooler to the work recovery device.

7. The refrigeration system of claim 6, wherein the controller is further configured to, in response to determining that the work recovery device is not needed to defrost the evaporator of the first evaporator unit, at least partially close the first valve to prevent the first flow of refrigerant from the gas cooler to the work recovery device.

8. The refrigeration system of claim 6, wherein the controller is further configured to, in response to determining that the work recovery device is not needed to defrost the evaporator of the first evaporator unit, at least partially open a second valve to allow flow of refrigerant from an oil separator to the first evaporator unit.

9. The refrigeration system of claim 1, wherein the controller is further configured to, in response to determining that defrosting of the evaporator of the first evaporator unit is needed, at least partially open a valve to allow flow of at least a portion of the second flow of refrigerant from the second outlet of the work recovery device to the first evaporator unit.

10. The refrigeration system of claim 1, wherein the controller is further configured to, in response to determining that defrosting of the evaporator of the first evaporator unit is needed, at least partially close a valve to prevent flow of refrigerant from an oil separator to the first evaporator unit.

11. A method of operating a refrigeration system, the method comprising:

determining defrost of an evaporator of a first evaporator unit is needed;

in response to determining that defrosting of the evaporator of the first evaporator unit is needed:

turning on a work recovery device;

causing the work recovery device, while turned on, to:

receive, at a first inlet, a first flow of refrigerant cooled by a gas cooler;

reduce a pressure of the first flow of refrigerant;

provide, from a first outlet, the first flow of refrigerant to a flash tank;

receive, at a second inlet, a second flow of refrigerant from at least one of the flash tank or a second evaporator unit that is operated in a refrigeration mode;

increase a pressure of the second flow of refrigerant; and provide, from a second outlet, the second flow of refrigerant to the first evaporator unit thereby defrosting the evaporator of the first evaporator unit;

wherein the work recovery device comprises a turbine.

12. The method of claim 11, further comprising:

determining whether defrost of an evaporator of the second evaporator unit is needed;

in response to determining that defrosting of the evaporator of the second evaporator unit is needed:

turning on the work recovery device; and causing the work recovery device, while turned on, to provide, from the second outlet, the second flow of refrigerant to the second evaporator unit thereby defrosting the evaporator of the second evaporator unit.

13. The method of claim 11, further comprising:

causing the first flow of the refrigerant from the gas cooler to the work recovery device, wherein the refrigerant from the gas cooler comprises vapor refrigerant; and causing the second flow of the refrigerant from the flash tank to the work recovery device.

14. The method of claim 11, wherein the refrigerant provided to the gas cooler is supplied from at least one of the first and second evaporator units that are operating in the refrigeration mode.

15. The method of claim 11, further comprising, in response to determining that the work recovery device is not needed to defrost the evaporator of the first evaporator unit, turning off the work recovery device.

16. The method of claim 11, further comprising, in response to determining that defrosting of the evaporator of the first evaporator unit is needed, at least partially opening a first valve to allow the first flow of refrigerant from the gas cooler to the work recovery device.

17. The method of claim 16, further comprising, in response to determining that the work recovery device is not needed to defrost the evaporator of the first evaporator unit, at least partially closing the first valve to prevent the first flow of refrigerant from the gas cooler to the work recovery device.

18. The method of claim 16, further comprising, in response to determining that the work recovery device is not needed to defrost the evaporator of the first evaporator unit, at least partially opening a second valve to allow flow of refrigerant from an oil separator to the first evaporator unit.

19. The method of claim 11, further comprising, in response to determining that defrosting of the evaporator of the first evaporator unit is needed, at least partially opening a valve to allow flow of at least a portion of the second flow of refrigerant from the second outlet of the work recovery device to the first evaporator unit.

20. The method of claim 11, further comprising, in response to determining that defrosting of the evaporator of the first evaporator unit is needed, at least partially closing a valve to prevent flow of refrigerant from an oil separator to the first evaporator unit.

* * * * *